United States Patent [19]

Castel et al.

[11] Patent Number: 4,541,754

[45] Date of Patent: Sep. 17, 1985

[54] DEVICE AND PROCESS FOR LOWERING A CONNECTOR SUSPENDED FROM GUIDE LINE TO A GUIDE COLUMN INSTALLED ON AN UNDERWATER STATION

[75] Inventors: Yvon Castel; Michel Iato, both of Pau, France

[73] Assignee: Societe Nationale Elf Aquitaine (Production) Tour Aquitaine, Paris la Defense, France

[21] Appl. No.: 506,495

[22] Filed: Jun. 21, 1983

[30] Foreign Application Priority Data

Jul. 6, 1982 [FR] France ..... 82 11816

[51] Int. Cl.[4] ..... E21B 15/02

[52] U.S. Cl. ..... 405/168; 166/341; 405/169

[58] Field of Search ..... 405/168–171, 405/195; 166/338–349

[56] References Cited

U.S. PATENT DOCUMENTS

| | | | |
|---|---|---|---|
| 2,981,347 | 4/1961 | Bauer | 175/7 |
| 3,493,043 | 2/1970 | Watkins | 166/352 X |
| 3,517,737 | 6/1970 | Petersen | 166/344 X |
| 3,983,708 | 10/1976 | Houot | 405/195 |
| 4,167,215 | 9/1979 | Thorne | 166/341 |
| 4,405,016 | 9/1983 | Best | 166/341 X |

FOREIGN PATENT DOCUMENTS

| | | |
|---|---|---|
| 2009179 | 1/1970 | France . |
| 2277227 | 1/1976 | France . |
| 2377517 | 8/1978 | France . |

*Primary Examiner*—Dennis L. Taylor

*Attorney, Agent, or Firm*—Poms, Smith, Lande & Rose

[57] ABSTRACT

An operation for re-entry to an underwater station equipped with a well apparatus.

The device comprises, fixed at the end of a rod 1 of a train of rods, a support 2 from which is suspended a module 3 formed by uprights 8 disposed concentrically and connected together, a receptacle 13 being fixed to the center of the module, which is provided with a conical housing 30 for retaining connector 15 and a re-entry cone 14, said module being suspended from the support 2 by the guide line 19 whose tension is maintained constant by the pounding compensation means formed by two cables 7 fixed to the two ends of support 2 and to the two uprights 12 of the module, while passing over fixed pulleys 20 and 21 and a mobile pulley 22 weighted with a counterweight 23.

A fitting device provided with means for compensating the pounding due to the swell.

9 Claims, 4 Drawing Figures

1
19
2
4
4
7
21
20
9
7
3
16
16
12
12
13
22
22
23
23
14
10
26
26
33
26
26
27
27
27
27

DEVICE AND PROCESS FOR LOWERING A CONNECTOR SUSPENDED FROM GUIDE LINE TO A GUIDE COLUMN INSTALLED ON AN UNDERWATER STATION

The present invention relates to a device for lowering and connecting a connector suspended from a guide line to a guide column installed on an underwater station, as well as a process for using such a device. Devices are known for effecting such lowering from a floating structure, but they present the disadvantage of being subject to the effects of pounding due to the swell. The cables by means of which connector fitting devices are lowered under the sea get tangled up as soon as they are no longer stretched under the effect of the weight which they support during lowering thereof.

The present invention provides a device comprising a system for compensating the pounding due to the swell. It is characterized in that it comprises, fixed to the end of a rod of a train of rods, a support from which is suspended a module formed by uprights disposed concentrically and connected together by peripheral and radial structural elements, a receptacle being fixed at the end of the module which is provided at its upper part with a conical housing for retaining the connector and, at its lower part, with a re-entry cone for capping, during the approach, the head of the guide column, said module being suspended from the support, on the one hand by the guide line carrying the connector whose tension is maintained constant during lowering and, on the other hand, by pounding compensation means.

Advantageously, the pounding compensation means are formed by two cables fixed to the two diametrically opposite ends of the support and to the two diametrically opposite uprights of the module, by passing over a system of pulley blocks, one mobile pulley of which is weighted with a counterweight.

According to a particularly advantageous embodiment, the module comprises at least four uprights spaced apart in the vicinity of the periphery of the module, the uprights disposed in a first axial plane of the module support fixed pulleys whereas to the uprights disposed in a second axial plane, offset with respect to the first one, are fixed the ends of the cables whose strands thus suspended pass over the weighted pulleys which are adapted for sliding and whose rising movement is limited by stops.

The invention also provides a process for using the device, which process is characterized in that on a floating structure a rod of a train of rods is fixed to the support to which are fixed two cables, whose opposite ends are secured, after passing over the system of pulley blocks, to the uprights of the module, the connector is housed in the sleeve by passing the guide line through the inside of the sleeve, the guide line being wound on a constant tension winch, the assembly of the support and the module are lowered into the sea while maintaining the tension for the guide line at a constant value and assembling the train of rods supporting the excess of the weight of the submerged assembly, lowering is continued and the submerged assembly is positioned with the help of a television camera so that the upper end of the guide column appears at the centre of a circle defined by signalling balls, the module is placed on the guide column to provide automatic locking of the connector, then the module and the support are raised along the guide line thus positioned.

Other features of the invention will appear from the following description of one embodiment illustrated with the help of the drawings in which.

Figure 1:
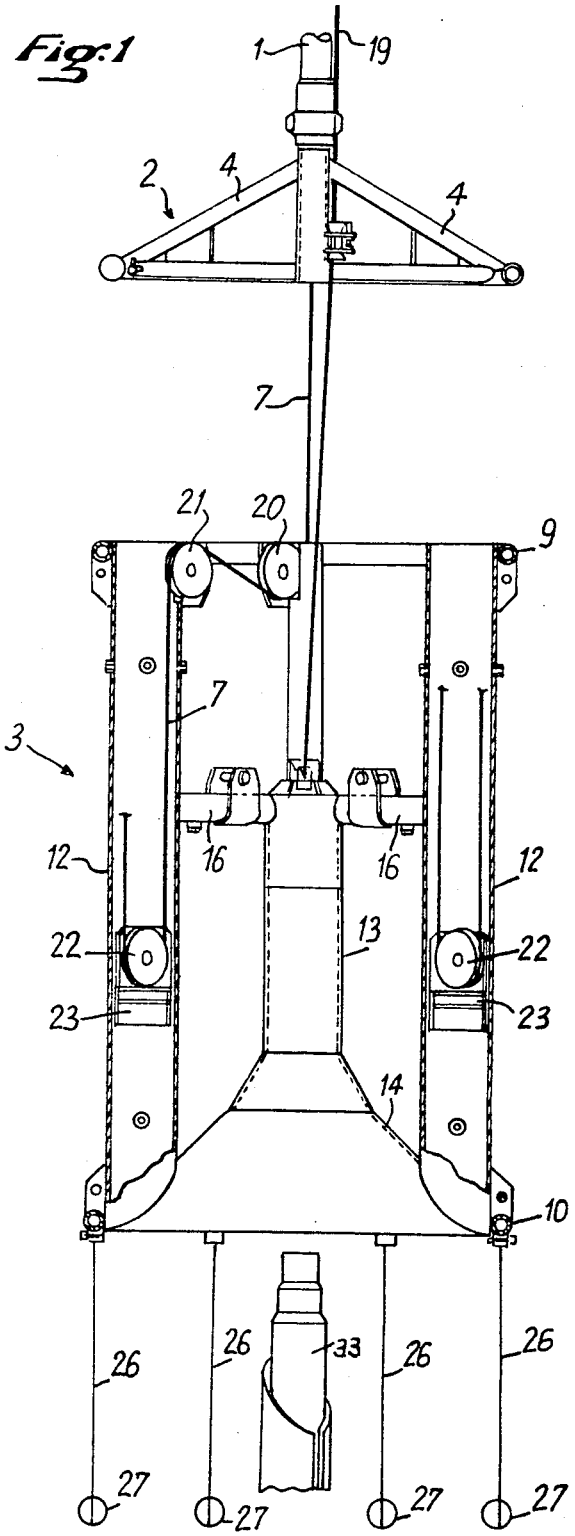
FIG. 1 shows a sectional view along A—A of FIG. 3.
Figure 2:
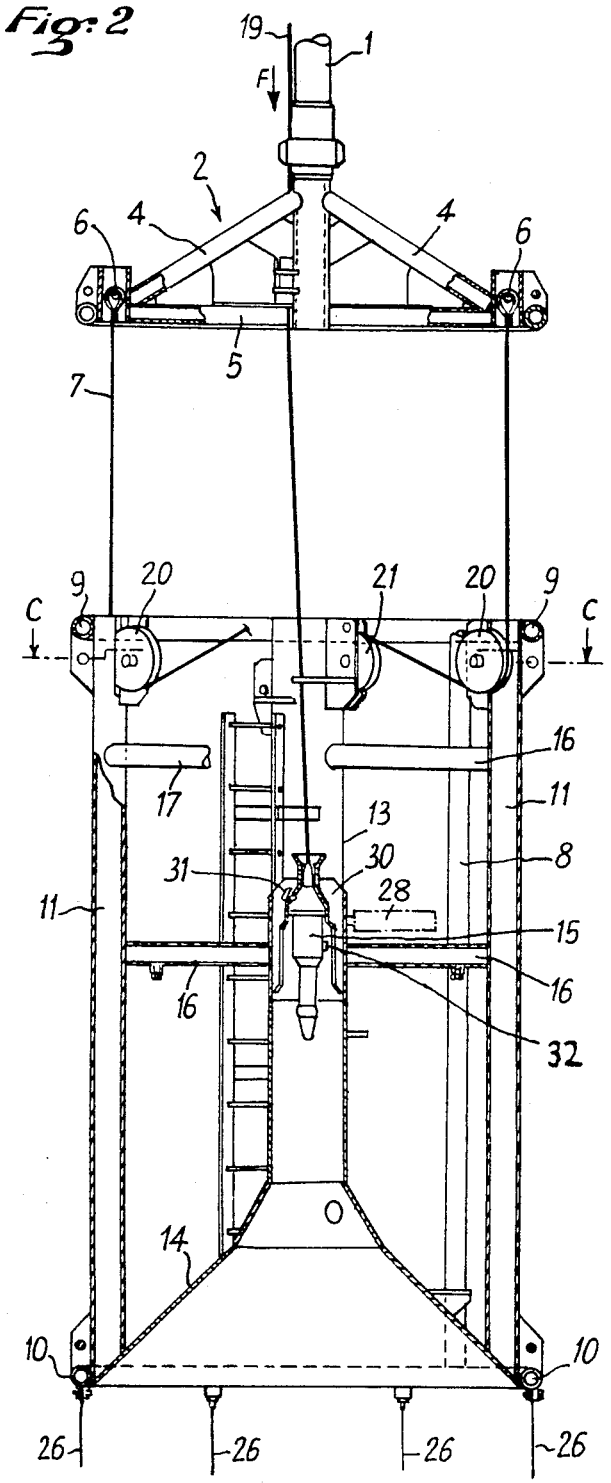
FIG. 2 is a sectional view along B—B of FIG. 3.
Figure 3:
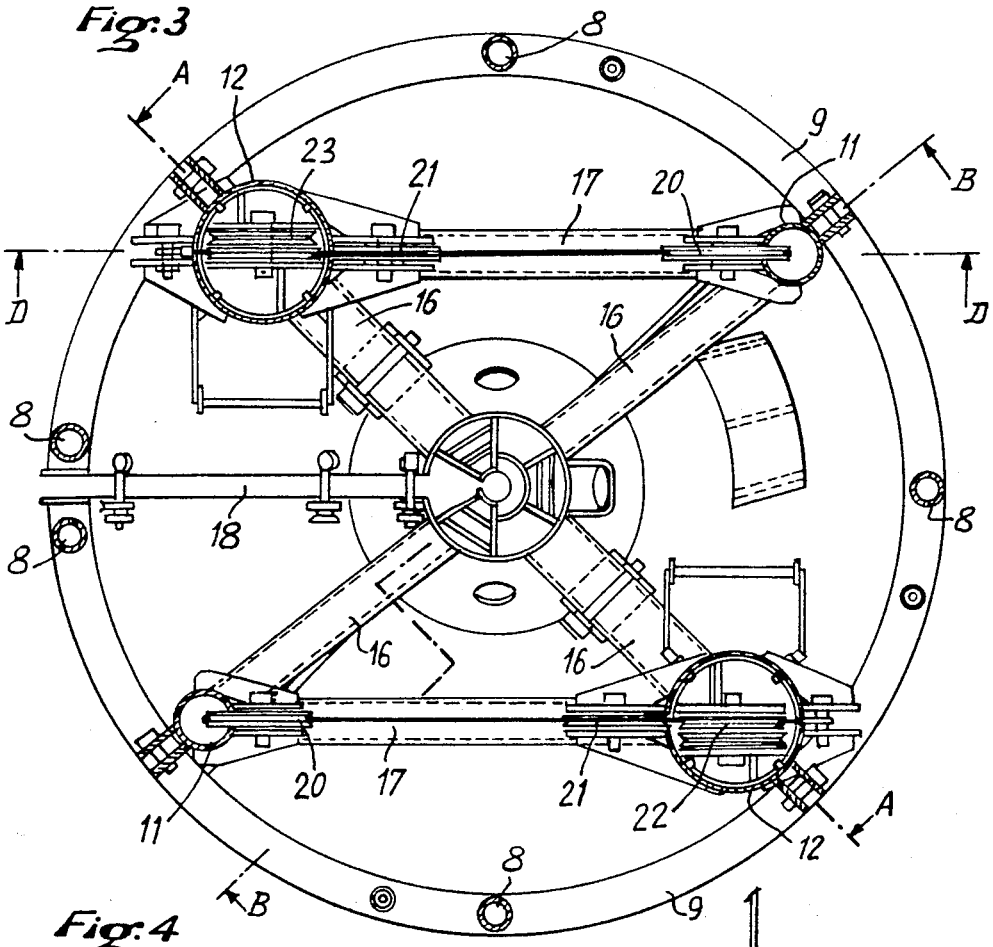
FIG. 3 is a sectional view along C—C of FIG. 2.
Figure 4:
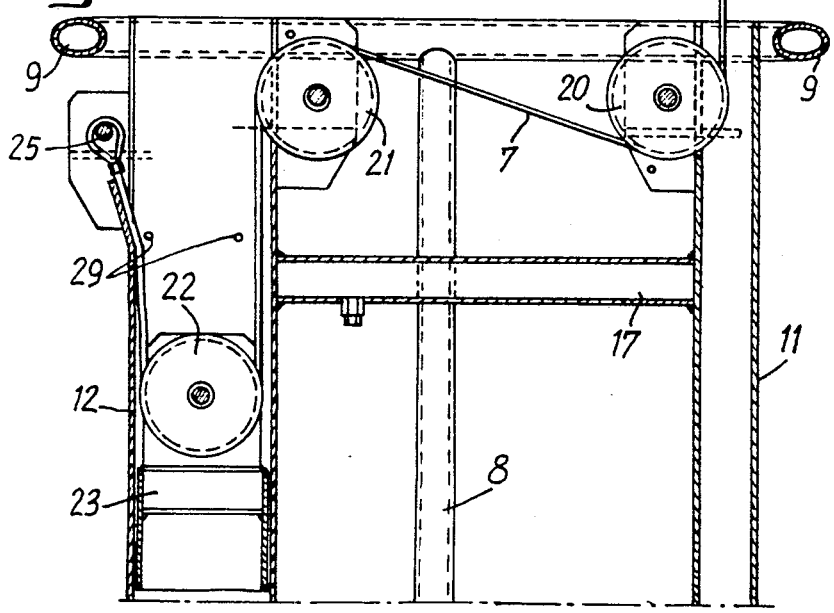
FIG. 4 is a sectional view along D—D of FIG. 3.

The device comprises, fixed at the end of a rod 1 of a train of rods, a support 2 from which is suspended a module 3. Support 2 is formed by six radial arms 4 connected together by a circular tube 5. Two diametrically opposite arms 4 carry hooks 6 to which are fixed two cables 7.

The module 3 comprises a framework formed by tubular uprights 8 welded at their upper ends to a circular tube 9 and at their lower ends to a circular tube 10. To the framework are fixed two diametrically opposed vertical tubes 11 and, opposite angularly with respect to these latter, two tubes of a larger diameter 12. Tubes 11 and 12 are fixed by their upper ends to the framework of the module. The further support in the centre of the module a receptacle for connector 15, formed by a tube 13 containing a conical housing 30 for the connector and a re-entry cone 14, by means of radial arms 16 and by securing the lower end thereof to the funnel 14.

The conical housing 30 is provided with rollers 31 adapted to cooperate with the upper truncated cone-shaped part of the connector 15 for centering. The connector 15, which may be the one described in patent application No. 81 00463 in the name of the applicant, carries on its outer face a guide finger 32 for cooperating with the helical ramps of the receptacle of the guide column 33.

Each pair of tubes 11 and 12 is connected together by a beam 17 passing through a secant of the circle represented by the cross-section of the module. The framework of the module has over half of its section a slit 18 provided with doors for the lateral introduction of the guide line 19 carrying the connector 15.

The device has two assemblies of pulley blocks, each of which is formed by a cable 7 and three pulleys: pulley 20 fixed to the upper end of tube 11, pulley 21 fixed to the outside of the upper end of tube 12 and mobile pulley 22 guided during movement inside tube 12 and fitted with a counterweight 23. With each assembly is associated a cable 7 one end of which is secured to the hook 6 of support 2 and at the other to hook 25 fixed to the upper part of tube 12.

The cable, coming down from support 2, passes over pulley 20 then over the change of direction pulley 21 and is finally engaged inside tube 12 where it passes over the weighted mobile pulley 32 to be fixed to the hook 25 integral with the module 3.

The lower circular periphery of the re-entry cone 14 carries six concentrically spaced cables 26 from which are suspended signalling balls 27 at a constant level. Two television cameras 28 offset by 90° are disposed in the vicinity of the re-entry tube 13.

The device which has been described is used in the following way. On a floating structure a rod 1 of a train of rods is assembled with support 2, to which are fixed the two cables 7, which pass successively over pulleys 20, 21 and 22 and are secured to hooks 25 of the module.

The guide line 19 is passed to the axis of module 3 through slit 18 so that connector 15 is housed in its conical housing 30. The guide line is wound on a winch fixed to the floating structure and operating at constant tension. The assembly of support 2 and module 3 is lowered so that, with the tension of the winch adjusted to the value of a ton, the train of rods supports the complement of the weight of the assembly.

Under the effect of the weight of the module, the counterweights 23, accompanied by pulley 22 rise as far as stops 29.

Cameras 28 detect the proximity of the guide column, which may be formed as described in patent application No. 78 00837 in the name of the applicant, namely a retractable guide column.

The floating structure by its movement allows positioning of the packet under the control of the cameras so that the head of the guide column 33 appears in the centre of the circle on which balls 27 are disposed. The module is placed on the guide column so as to obtain automatic locking of the connector inside the sleeve of the column. When the weight of the module rests on the head of the guide column or exercises a lesser pull on support 2 from which it is suspended, the pulley block device comes into action. The mobile pulleys 22 descend and the cables stretched under the effect of counterweights 23 guided in their descent inside tubes 12 do not risk getting tangled up. When the guide line is fixed to the guide column by means of the connector, the module and the support may be raised along the guide line thus positioned.

The device of the invention is not limited to the embodiment described, variations may be introduced by a man skilled in the art, particularly insofar as the type of anti-pounding system, the arrangement and the number of pulleys and the mode of suspension are concerned.

We claim:

1. A device for lowering a connector (15) from a floating structure to a guide column (33) on a subsea installation, said connector (15) being suspended from a guideline (19) connected with said floating structure, comprising in combination:

a support means (2);

rod means fixed to said support means and connecting said support means with said floating structure;

a module (3) having a vertical axis, spaced below said support means and including structural members arranged about said axis;

a cable means (7) suspending said module from said support means;

means for connecting said connector (15) to said module (3);

means for guiding said module (3) over said guide column (33) as the device is lowered and approaches the guide column;

means for maintaining constant tension in the guideline (19) during lowering;

and means for maintaining said cable means (7) under tension when the downward pull of the module suspended from the support (2) is lessened as the connector (15) and guide column (33) become connected.

2. A device as claimed in claim 1 wherein said cable means includes a pulley block means carried by said module;

said pulley block means including a mobile pulley (22) having a counterweight to maintain tension in said cable means.

3. A device as claimed in claim 2 wherein:

said weighted mobile pulley is freely slidably guided in one of said module structure members, said latter structural member including a stop to limit upward movement of said mobile weighted pulley.

4. A device as claimed in claim 1 wherein:

support means (2) includes several radial arms having their outer ends interconnected by a peripheral member.

5. A device as claimed in claim 1 wherein said module means includes:

a conical housing (30) having rollers (31);

said connector (15) having an upper truncated cone-shaped part adapted to cooperate with said rollers (31) for centering.

6. A device as claimed in claim 1 wherein:

said connector (15) includes a guide finger (32);

said guide column (33) having helical ramps cooperable with said guide finger.

7. A device as stated in claim 1 where said module comprises at least four upright structural members spaced apart in the vicinity of the periphery of the module, one set of uprights (11) being disposed in a first plane passing through said axis of said module and carrying fixed pulleys (20);

a second set of upright structural members (12) disposed in a second plane offset with respect to said first plane;

means fixing ends of the cable means (7) to the second set of upright members (12);

and mobile weighted pulleys (22) freely slidably guideable in said upright members (12) and connected to said cable means (7) for maintaining said cable means under tension.

8. A device as claimed in claim 1 including a plurality of signalling balls (27) suspended from said module means at a constant level;

and a television camera (28) suspended from said floating structure and disposed in the vicinity of said connector (15).

9. A method of lowering and connecting a connector (15) suspended from a guideline (19) to a guide column (33) in which said connector (15) is housed within a module (3) which is suspended by cables from a support means (2) connected to a train of rods (1) supported by a floating structure, the guideline being wound on a constant tension winch the steps of:

lowering the assembly of the support means and the module means into the sea while maintaining tension on the guideline at a constant value and while supporting the excess weight of the submerged assembly by said train of rods;

positioning said submerged assembly by means of a television camera so that the upper end of the guide column is generally aligned with said connector being lowered;

lowering the module into position over the guide column for automatic locking of the connector to the guide column;

and raising the module and support assembly along the connected guideline while maintaining tension in cables suspending the module from the support means.

* * * * *